US010662933B2

(12) United States Patent
Dicken et al.

(10) Patent No.: US 10,662,933 B2
(45) Date of Patent: May 26, 2020

(54) SYMMETRIC FLOATING COIL COMPRESSOR

(71) Applicant: Carleton Life Support Systems, Inc., Davenport, IA (US)

(72) Inventors: Lane Daniel Dicken, Long Grove, IA (US); Dennis Eugene Lund, Jr., Bettendorf, IA (US); Andrew Ray Cook, Davenport, IA (US); Mark Russell Squires, Davenport, IA (US)

(73) Assignee: Cobham Mission Systems Davenport LSS Inc., Davenport, IA (US)

( * ) Notice: Subject to any disclaimer, the term of this patent is extended or adjusted under 35 U.S.C. 154(b) by 242 days.

(21) Appl. No.: 15/430,062

(22) Filed: Feb. 10, 2017

(65) Prior Publication Data

US 2017/0234581 A1 Aug. 17, 2017

Related U.S. Application Data

(60) Provisional application No. 62/294,078, filed on Feb. 11, 2016.

(51) Int. Cl.

| | |
|---|---|
| ***F25B 9/14*** | (2006.01) |
| ***F04B 35/04*** | (2006.01) |
| ***F04B 37/08*** | (2006.01) |
| ***H01F 27/30*** | (2006.01) |
| ***H01F 5/04*** | (2006.01) |

(52) U.S. Cl.

CPC ..... *F04B 35/04* (2013.01); *F04B 37/08* (2013.01); *F25B 9/14* (2013.01); *H01F 5/04* (2013.01); *H01F 27/306* (2013.01)

(58) Field of Classification Search

CPC ..... F25B 9/14; H01R 13/00; H01R 13/6315

See application file for complete search history.

(56) References Cited

U.S. PATENT DOCUMENTS

| | | | | |
|---|---|---|---|---|
| 4,148,469 | A | 4/1979 | Geyer | |
| 5,822,994 | A | 10/1998 | Belk et al. | |
| 5,944,302 | A | 8/1999 | Loc et al. | |
| 6,079,960 | A * | 6/2000 | Funatsu | F04B 35/045 417/313 |
| 6,205,791 | B1 | 3/2001 | Smith, Jr. | |
| 7,078,832 | B2 | 7/2006 | Inagaki et al. | |
| 7,587,896 | B2 | 9/2009 | Bin-Nun et al. | |

(Continued)

OTHER PUBLICATIONS

Veprik, A. et al., Split Stirling Linear Cryogenic Cooler for a New Generation of High Temperature Infrared Imagers, http://www.ricor.com/wp-content/uploads/file/K527%20linear%20cooler%20for%20high%20temperature%20infrared%20imagers.pdf (Accessed Jul. 14, 2014).

*Primary Examiner* — Brian M King

(74) *Attorney, Agent, or Firm* — Woods Oviatt Gilman LLP; Katherine H. McGuire, Esq.

(57) ABSTRACT

A floating coil configuration for a compressor of a closed cycle cryogenic cooler, the coil configuration comprises a coil having a positive end and a negative end and first and second springs concentrically located within the coil, each spring having a first end and a second end. The positive end of the coil is coupled to the first end of the first spring and the negative end of the coil is coupled to the second end of the second spring. The second end of the first spring is electrically coupled to the first end of the second spring such that the first and second springs define an electrical path across the coil.

4 Claims, 3 Drawing Sheets

(56) References Cited

U.S. PATENT DOCUMENTS

| | | | | |
|---|---|---|---|---|
| 8,127,560 | B2 | 3/2012 | Dicken et al. | |
| 8,378,218 | B2 | 2/2013 | Dicken et al. | |
| 8,733,112 | B2 | 5/2014 | Hon et al. | |
| 9,739,270 | B2 * | 8/2017 | Beers | F04B 39/0005 |
| 2002/0057974 | A1 | 5/2002 | Toyama et al. | |
| 2008/0295523 | A1 | 12/2008 | Dicken et al. | |
| 2013/0139381 | A1 * | 6/2013 | Dicken | H01R 13/2421 29/825 |
| 2013/0220111 | A1 | 8/2013 | Yamada | |

* cited by examiner

SYMMETRIC FLOATING COIL COMPRESSOR

CROSS-REFERENCE TO RELATED APPLICATIONS

This application claims the benefit of U.S. Provisional Application No. 62/294,078 entitled "Symmetric Floating Coil Compressor" filed Feb. 11, 2016, the entirety of which is incorporated herein by reference.

FIELD OF THE INVENTION

The present invention generally relates to electrically conductive coil configurations useful in devices and assemblies requiring an electric pathway between spaced components. More particularly, the present invention relates to coil systems comprising radially symmetric floating coil configurations for use in compressors of a closed cycle cryogenic cooler.

BACKGROUND OF THE INVENTION

Although the present invention may be useful in any number of devices, one type of device requiring an electrically wired connection is a closed cycle cryogenic cooler (hereinafter "CCCC"), which is commonly used to cool devices such as infrared detectors. One such example of a CCCC may be seen in U.S. Pat. No. 5,822,994 ("the '944 patent"), the entire disclosure of which is incorporated herein by reference. Specifically, the CCCC of the '994 patent comprises a compressor section incorporating reciprocating pistons which are mechanically/pneumatically driven by a prior art coil system.

As can be seen in FIG. 1, an example of the prior art coil system 8 of the compressor of the '994 patent incorporates a number of compression springs 10 to position motor coils 12 in a floating configuration. While such floating configurations generally reduce negative impacts when side loading the compressor section, these configurations further require a number of additional springs 14 on the opposite axial side of the coil 12 to restore force balance. Moreover, the system incorporates an electrical conduit network 18 in which the electrical current enters the same axial side of the system in which the current is returned. Since rotation may misalign the spring seats (not shown) and cause electrical disconnection of conduit network 18, a guide pin 16 is thus required to restrict rotation of the coil 12. A clocking guide (not shown) is also required to accommodate for the relative movement of the springs 10, 14 and ensure compressor functionality.

Another example of a prior art coil system can be seen in FIG. 2 and is generally indicated by reference number 8'. Coil system 8' incorporates a symmetric pair of flexure springs 10' to position motor coils 12' in a concentric manner. While this configuration reduces the part count of other prior art coil configurations, springs 10' are generally manufactured from electrically conductive material having a significant radial stiffness. Coils 12' must also be mounted in a certain fixed position within the compressor so as to both prevent the need for a clocking guide and allow for incorporation of electrical conduit network 18' (in which electrical current enters and returns on one axial side). Such mounting of coils 12', however, hinders coil functionality since the coils are unable to float and self-align within the compressor. Moreover, assembly of system 8' is complex due to coils 12', springs 10', and conduit network 18' being required to be mounted with a certain degree of accuracy for these components to function properly.

There therefore remains a need for a system comprising a coil configuration that reduces the number of assembly components found in prior art floating coil configurations but without the loss of coil rotation and functionality accompanying prior art symmetric coil configurations, as well as other needs.

SUMMARY OF THE INVENTION

The present invention is generally directed to a floating coil configuration for use with a compressor of a closed cycle cryogenic cooler; although those skilled in the art will recognize that the floating coil configuration described herein may be applicable within any number of suitable technologies. To that end, a coil configuration may comprise a coil having a positive end and a negative end and first and second springs concentrically located within the coil, each spring having a first end and a second end. The positive end of the coil may be coupled to the first end of the first spring while the negative end of the coil may be coupled to the second end of the second spring. The second end of the first spring may be electrically coupled to the first end of the second spring such that the first and second springs define an electrical path across the coil.

In a further aspect of the present invention, the coil configuration may further include a first spring seat and a second spring seat. The first spring seat may be configured to receive the first end of the first spring with the positive end of the coil connected to the first spring seat while the second spring seat may be configured to receive the second end of the second spring with the negative end of the coil connected to the second spring seat. In this manner, the coil may be configured to freely rotate when energized by the compressor. The coil, first spring and second spring may each be fabricated from a conductive material, such as but not limited to, stainless steel.

In another aspect of the present invention, the coil configuration may further include a first conduit coupled to the retainer and a second conduit coupled to the flange. Each conduit may be configured to enable axial movement of its respective first or second spring. Each conduit may be coupled to an electrical coupling where the electrical coupling includes a positive terminus and a negative terminus configured for connecting with a power source. The first conduit may be coupled to the positive terminus while the second conduit may be coupled to the negative terminus.

In still a further aspect of the present invention, a coil system for a compressor of a closed cycle cryogenic cooler may comprise first and second electrically conducting floating coil configurations positioned in a radially symmetric manner. Each of the first and second floating coil configurations may in turn comprise a coil having a positive end and a negative end and first and second springs concentrically located within the coil, each spring having a first end and a second end. The positive end of the coil may be coupled to the first end of the first spring while the negative end of the coil may be coupled to the second end of the second spring. The system may also include an electric coupling having a positive terminus and a negative terminus configured for connecting with a power source. Each of the second ends of the respective first springs may be electrically coupled to the positive terminus and each of the first ends of the respective second springs may be electrically coupled to the negative terminus.

Additional objects, advantages and novel aspects of the present invention will be set forth in part in the description which follows, and will in part become apparent to those in the practice of the invention, when considered with the attached figures.

DETAILED DESCRIPTION OF THE PREFERRED EMBODIMENTS

Figure 1:
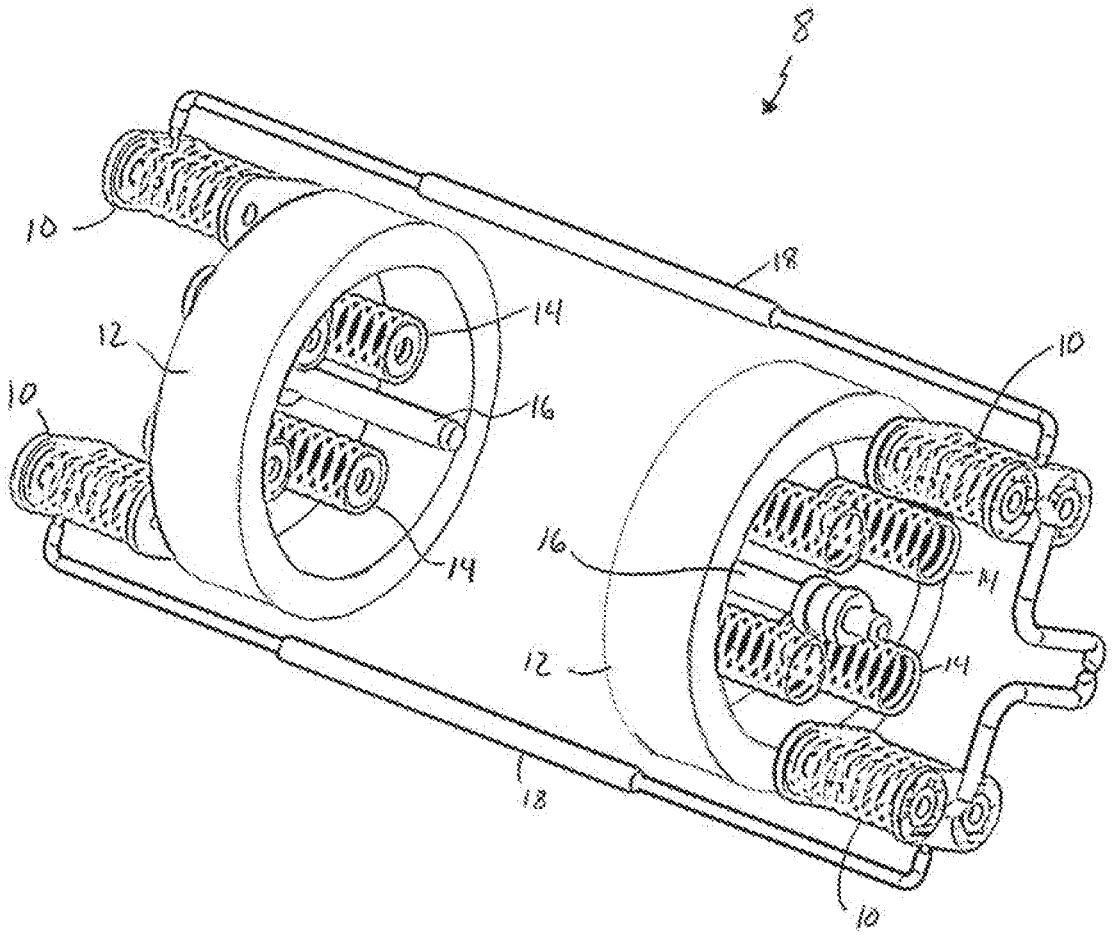
FIG. 1 PRIOR ART
FIG. 1 is a perspective view of an example of a prior art floating coil configuration.
Figure 2:
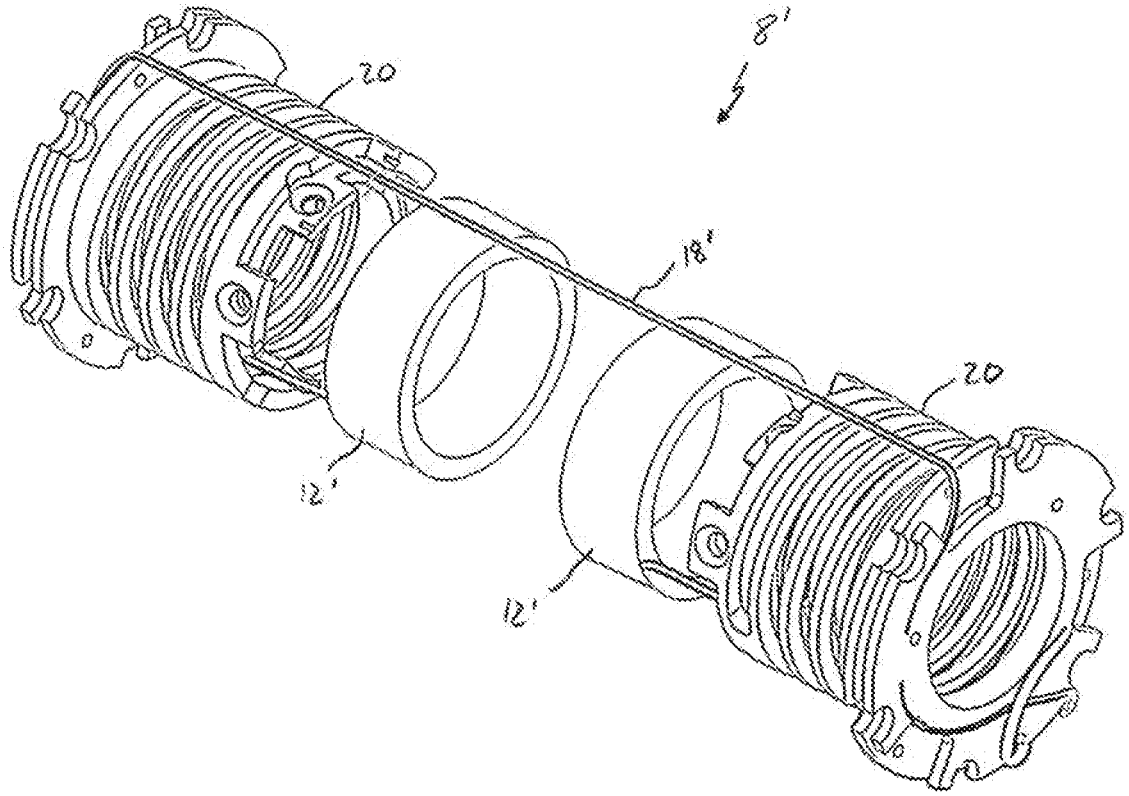
FIG. 2 PRIOR ART
FIG. 2 is a perspective view of an example of a prior art symmetric coil configuration.
Figure 3:
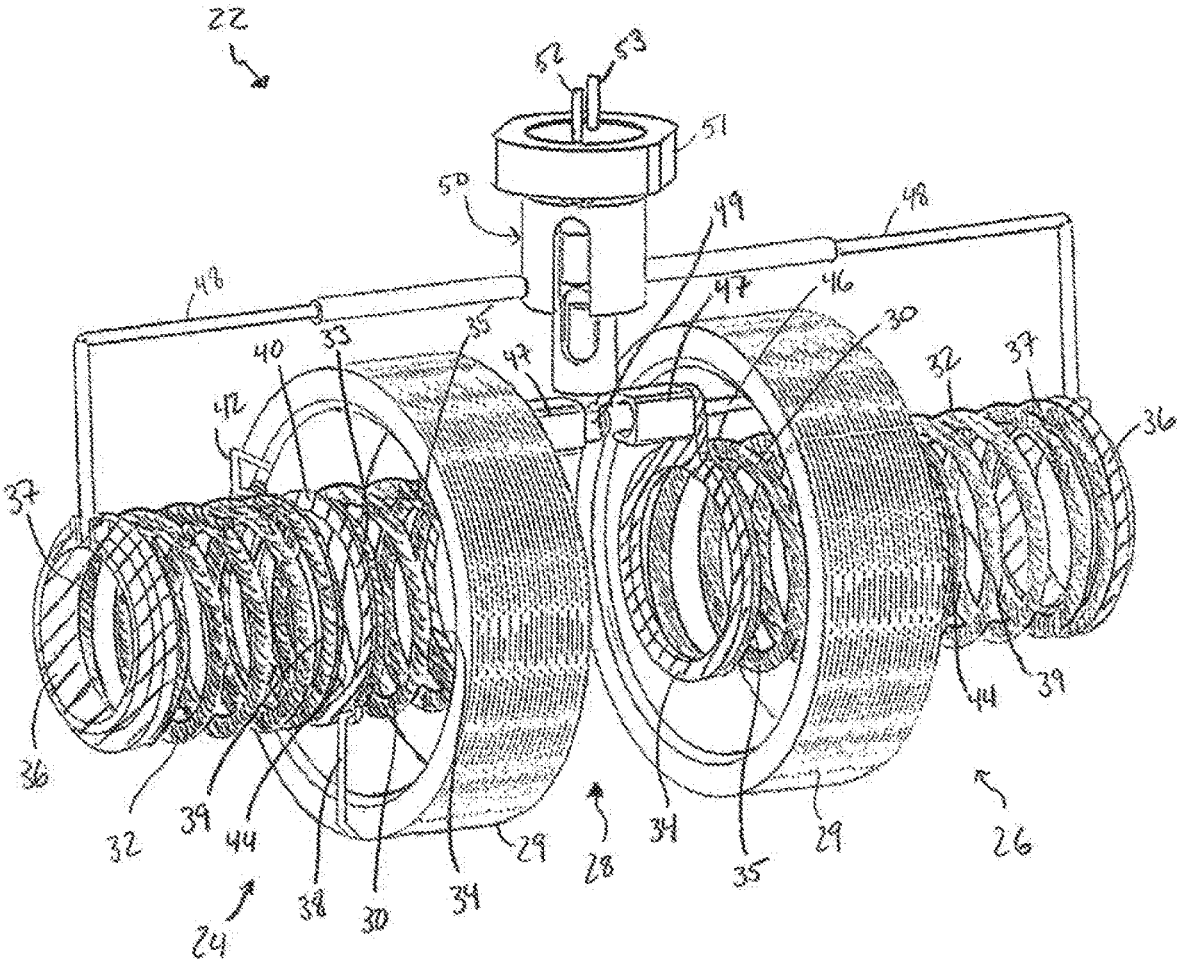
FIG. 3 is a perspective view of an embodiment of a floating coil configuration in accordance with the present invention.

Referring now to FIG. 3, an embodiment of a coil system for a CCCC (not shown) is generally indicated by reference number 22. System 22 includes a first floating coil configuration 24 and a second floating coil configuration 26 which are oriented in an axially symmetric manner. That is, each coil configuration 24, 26 is a mirror image of the other and both are separated from each other by a centrally located coil gap 28.

Specifically, each respective coil configuration 24, 26 includes a floating coil 29 (e.g., motor coil) that incorporates a first spring 30 and second spring 32, at least a portion of which is concentrically situated within the confines of coil 29. Coil 29 is also axially positioned between a retainer 34 mounted to retainer end 35 of first spring 30 and a flange 36 mounted to flange end 37 of second spring 32. A second end 38 of coil 29 (i.e., a negative end) may be coupled to first spring seat 40 against which is seated seat end 33 of first spring 30. A first end 42 of coil 29 (i.e., a positive end) may be coupled to a second spring seat 44, against which is seated seat end 39 of second spring 32.

In an aspect of the present invention, coil 29, first spring 30, and/or second spring 32 may be manufactured from an electrically conductive material such as, but not limited to, stainless steel. It will therefore be appreciated that the electrical connectivity between coil 29 and first and second springs 30, 32 defines a continuous and flexible, electrical connection from retainer 34 to flange 36.

Retainer 34 may be coupled to an electrically conductive lower mounting conduit 46, such as by way of bushing 47. Flange 36 may be coupled to an electrically conductive upper mounting conduit 48. Mounting conduits 46, 48 may provide a translational support which allows both springs 30, 32 to float concentrically within corresponding coil 29. Lower mounting conduit 46 may also provide support to allow coil 29 to have a floating configuration.

Lower mounting conduit 46 may be coupled to base 49 of electrical coupling 50 while upper mounting conduit 48 may be coupled to coupling 50 between base 49 and top end 51. Positive and negative termini 52, 53, respectively, may protrude from top end 51 of coupling 50 thereby enabling coil system 22 to be releasably connected to a power source (not shown) where coil 29 will act as a load when coupling 50 is connected to the power source. Thus, when energized, electrical current will flow from coupling 50, through upper mounting conduit 48 and into second spring 32 via flange 36. The electrical current will then flow into positive end of coil 29 via first end 42 and second spring seat 44. Once expended by coil 29, current will then flow from negative end 38 of coil 29 and into first spring 30 through first spring seat 40. The current will ultimately return to coupling 50 via retainer 34 and lower mounting conduit 46 and 47. Electrical current may thus flow into one axial side of the coil configuration 24/26 and out the opposite, eliminating the need for a clocking guide to keep the coil seats (not shown) aligned.

Moreover, when energized, springs 30, 32 of coil configurations 24, 26 may act in concert with each other by moving back and forth axially (i.e., towards and away from coil gap 28) as well as in a reciprocal manner to the simultaneous movement of the springs of the opposing configuration. A piston (not shown) may also be connected to coil 29 to move axially with springs 30, 32 (i.e., towards and away from coil gap 28). As can be appreciated by the above discussion, coil 29 may be free to rotate and self-align without the risk of conductor damage or electrical current disconnection while energized.

The foregoing description of the preferred embodiment of the invention has been presented for the purpose of illustration and description. It is not intended to be exhaustive nor is it intended to limit the invention to the precise form disclosed. It will be apparent to those skilled in the art that the disclosed embodiments may be modified in light of the above teachings. The embodiments described are chosen to provide an illustration of principles of the invention and its practical application to enable thereby one of ordinary skill in the art to utilize the invention in various embodiments and with various modifications as are suited to the particular use contemplated. Therefore, the foregoing description is to be considered exemplary, rather than limiting, and the true scope of the invention is that described in the following claims.

What is claimed is:

1. A first floating coil configuration for a compressor of a closed cycle cryogenic cooler, the first floating coil configuration comprising:

a. a coil having a first positive end and a second negative end;

b. first and second springs arranged in collinear alignment with said first spring concentrically located within and spaced radially inwardly of said coil, said first spring having a seat end attached to a first spring seat and a retainer end attached to a first spring retainer, said second spring having a seat end attached to a second spring seat and a flange end attached to a flange, said first spring seat and said second spring seat being electrically connected to each other;

wherein the positive end of the coil is coupled to the seat end of the second spring and the negative end of the coil is coupled to the first spring seat;

c. an electrical coupling;

d. an upper mounting conduit extending between said electrical coupling and said flange of said second spring, said upper mounting conduit configured to enable axial movement of said second spring; and e) a lower mounting conduit extending between said electrical coupling and said retainer of said first spring, said lower mounting conduit configured to enable axial movement of said first spring, wherein said upper and lower mounting conduits support said second and first springs, respectively, in said collinear alignment, wherein upon connecting said electrical coupling to an electrical power source, electrical current will flow from said electrical coupling through said upper mounting conduit and into said second spring via said flange, said electrical current then flowing into said coil first positive end and said second spring seat end, electrical current then flowing from said coil second negative end and into said first spring through said first spring seat, the current returning to said coupling via said first spring retainer and said lower mounting conduit.

2. The coil configuration of claim 1 wherein the coil is configured to freely rotate when energized by the compressor.

3. The coil configuration of claim 1 wherein each of the coil, the first spring and the second spring is fabricated from a conductive material.

4. The first floating coil configuration of claim 1, and further comprising a second floating coil configuration comprising a mirror image of said first floating coil configuration, said first and second floating coil configurations arranged in axial alignment and separated by a coil gap wherein said first springs of each said first and second floating coil configurations may axially translate in reciprocating manner.

* * * * *